US010775070B2

(12) United States Patent
Brizendine et al.

(10) Patent No.: US 10,775,070 B2
(45) Date of Patent: Sep. 15, 2020

(54) METHOD FOR SOLVING CHARGE IMBALANCE IN EXISTING SPLIT HEAT PUMP

(71) Applicant: Lennox Industries Inc., Richardson, TX (US)

(72) Inventors: Tim Brizendine, Rockwall, TX (US); Jeff Mangum, Argyle, TX (US); Bruce Perkins, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 153 days.

(21) Appl. No.: 15/632,035

(22) Filed: Jun. 23, 2017

(65) Prior Publication Data

US 2018/0372354 A1 Dec. 27, 2018

(51) Int. Cl.

| | |
|---|---|
| ***F24F 11/83*** | (2018.01) |
| ***F24F 1/06*** | (2011.01) |
| ***F24F 11/72*** | (2018.01) |
| ***F25B 13/00*** | (2006.01) |
| ***F25B 49/02*** | (2006.01) |
| ***F24F 1/0003*** | (2019.01) |
| ***F25B 45/00*** | (2006.01) |
| *F24F 140/12* | (2018.01) |

(52) U.S. Cl.

CPC ..... *F24F 11/83* (2018.01); *F24F 1/0003* (2013.01); *F24F 1/06* (2013.01); *F24F 11/72* (2018.01); *F25B 13/00* (2013.01); *F25B 45/00* (2013.01); *F25B 49/02* (2013.01); *F24F 2140/12* (2018.01); *F24F 2221/54* (2013.01); *F25B 2313/008* (2013.01); *F25B 2400/19* (2013.01); *F25B 2400/24* (2013.01); *F25B 2500/06* (2013.01); *F25B 2500/24* (2013.01)

(58) Field of Classification Search

CPC ..... F24F 11/83; F24F 11/873; F24F 11/72; F24F 1/06; F24F 2221/54; F25B 45/00; F25B 49/02; F25B 2400/16; F25B 2500/07; F25B 2500/23; F25B 2500/24; F25B 2321/023

USPC ..... 62/115

See application file for complete search history.

(56) References Cited

U.S. PATENT DOCUMENTS

| | | | | |
|---|---|---|---|---|
| 4,641,503 | A * | 2/1987 | Kobayashi | F24F 1/0003 62/259.1 |
| 8,578,731 | B2 * | 11/2013 | Jin | F25B 13/00 62/324.4 |
| 9,459,025 | B2 * | 10/2016 | Lee | F25B 13/00 |
| 2005/0132728 | A1 * | 6/2005 | Lifson | F25B 45/00 62/149 |
| 2006/0101835 | A1 * | 5/2006 | Meldahl | B60H 1/00585 62/149 |
| 2013/0199224 | A1 * | 8/2013 | Kato | F25B 49/02 62/159 |

(Continued)

*Primary Examiner* — Joseph F Trpisovsky
(74) *Attorney, Agent, or Firm* — Baker Botts L.L.P.

(57) ABSTRACT

A system and method are described that help in alleviating charge imbalance issues, especially in HVAC systems that are operable in both heating and cooling modes. In various embodiments a compensator is attached to the liquid line of an outdoor heat exchanger. A heater is attached to the compensator. During cooling operations the heater is turned on to help drive refrigerant out of the compensator. During heating operations the heater is turned off, allowing excess refrigerant to migrate to the compensator and alleviate high pressure in the system.

11 Claims, 5 Drawing Sheets

(56) References Cited

U.S. PATENT DOCUMENTS

| | | | | |
|---|---|---|---|---|
| 2015/0330684 | A1* | 11/2015 | Goel | F25B 41/003 137/14 |
| 2016/0327303 | A1* | 11/2016 | Tomita | F24F 11/89 |
| 2017/0198953 | A1* | 7/2017 | Connell | F25B 13/00 |

* cited by examiner

METHOD FOR SOLVING CHARGE IMBALANCE IN EXISTING SPLIT HEAT PUMP

TECHNICAL FIELD

The present disclosure is directed to reversible HVAC systems and in particular to charge compensators.

BACKGROUND OF THE INVENTION

HVAC systems can comprise an indoor heat exchanger, an outdoor heat exchanger, a compressor, an expansion device, and other components. Some HVAC systems may comprise a reversing valve, enabling the system to function both as a heat pump and as an air conditioner. During heating modes the indoor heat exchanger functions as a condenser and the outdoor heat exchanger functions as an evaporator. During cooling modes the roles of the heat exchangers are reversed. The indoor and outdoor heat exchangers are typically the same size, but not always. Different sized heat exchangers may be due to space constraints, material differences, or other reasons. The volume ratio of indoor to outdoor coils may lead to charge imbalances, leading to high pressure and other problems.

BRIEF SUMMARY OF THE INVENTION

One possible embodiment under the present disclosure can comprise a compensator for an HVAC system operable in both a cooling mode and a heating mode, comprising: an inlet configured to be coupled to a liquid line of a heat exchanger; a tank configured to receive refrigerant from the liquid line when the HVAC system is in a heating mode; and a heater electrically coupled to the HVAC system, wherein when the HVAC system is in a cooling mode then the heater is turned on, wherein the heater is operable to cause refrigerant in the compensator to migrate out of the compensator.

Another possible embodiment under the present disclosure can comprise an HVAC system operable in both a heating mode and a cooling mode comprising: an indoor heat exchanger operable to receive a refrigerant and transfer heat between the refrigerant and another medium; a compressor operable to receive the refrigerant from the indoor heat exchanger when the HVAC system is in a cooling mode; an outdoor heat exchanger operable to receive the refrigerant from the compressor when the HVAC system is in a cooling mode, an outlet of the outdoor heat exchanger comprising a liquid line when the HVAC system is in a cooling mode; an expansion valve operable to receive the refrigerant from the outdoor heat exchanger and to direct the refrigerant toward the indoor heat exchanger when the HVAC system is in a cooling mode; and a compensator comprising: an inlet configured to be coupled to the liquid line of the outdoor heat exchanger; a tank configured to receive refrigerant from the liquid line when the HVAC system is in a heating mode; and a heater electrically coupled to the HVAC system, wherein when the HVAC system is in a cooling mode then the heater is turned on, wherein the heater is operable to cause refrigerant in the compensator to migrate out of the compensator.

Another possible embodiment under the present disclosure can comprise a method of alleviating charge imbalance in an HVAC system that is operable in both a cooling mode and a heating mode, comprising: circulating a refrigerant through an indoor heat exchanger, an outdoor heat exchanger, a compressor and an expansion device, wherein a compensator is coupled to a liquid line of the outdoor heat exchanger; allowing refrigerant to flow into the compensator when the HVAC system is in a heating mode; and heating the compensator when the HVAC system is in a cooling mode in order to cause the refrigerant to migrate out of the compensator.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

When aluminum components are used to replace copper ones in HVAC systems, the load carrying capacities of the components may change, leading to charge imbalance issues and high pressure. A typical HVAC system comprises both an indoor and an outdoor heat exchanger. Copper has historically been the preferred material for heat exchanger tubes. Aluminum is being used more and more frequently however. The move from copper to aluminum may be for environmental, cost, or other reasons. Typically, the same material is used for both the indoor and outdoor heat exchangers. Sometimes however, existing HVAC systems are repaired or updated by replacing a copper component with an aluminum one, or another material switch. When an aluminum coil replaces a copper coil an installer usually keeps the same physical size due to pre-existing space constraints. Because aluminum is weaker than copper, a similarly sized (same outside diameter) aluminum heat exchanger tube will have a smaller inner diameter than a copper tube. This is because the aluminum walls must be made thicker to provide an equivalent amount of strength. But this means that the aluminum coil can circulate less refrigerant than a similar copper coil. One consequence of combining, for example, an indoor aluminum coil with an outdoor copper coil can be a charge imbalance, i.e. the heating and cooling modes require different amounts of refrigerant. During heating operations there may be too much refrigerant passing through the indoor aluminum coil creating high pressure. The removal of refrigerant can help relieve the pressure. But when the system is switched to cooling mode the larger amount of refrigerant is needed to achieve greater heat transfer and provide sufficient cooling to the conditioned space. Similar problems can occur when space constraints force an indoor or outdoor coil to be smaller than the other, even if both coils are made of the same material.

Figure 1:
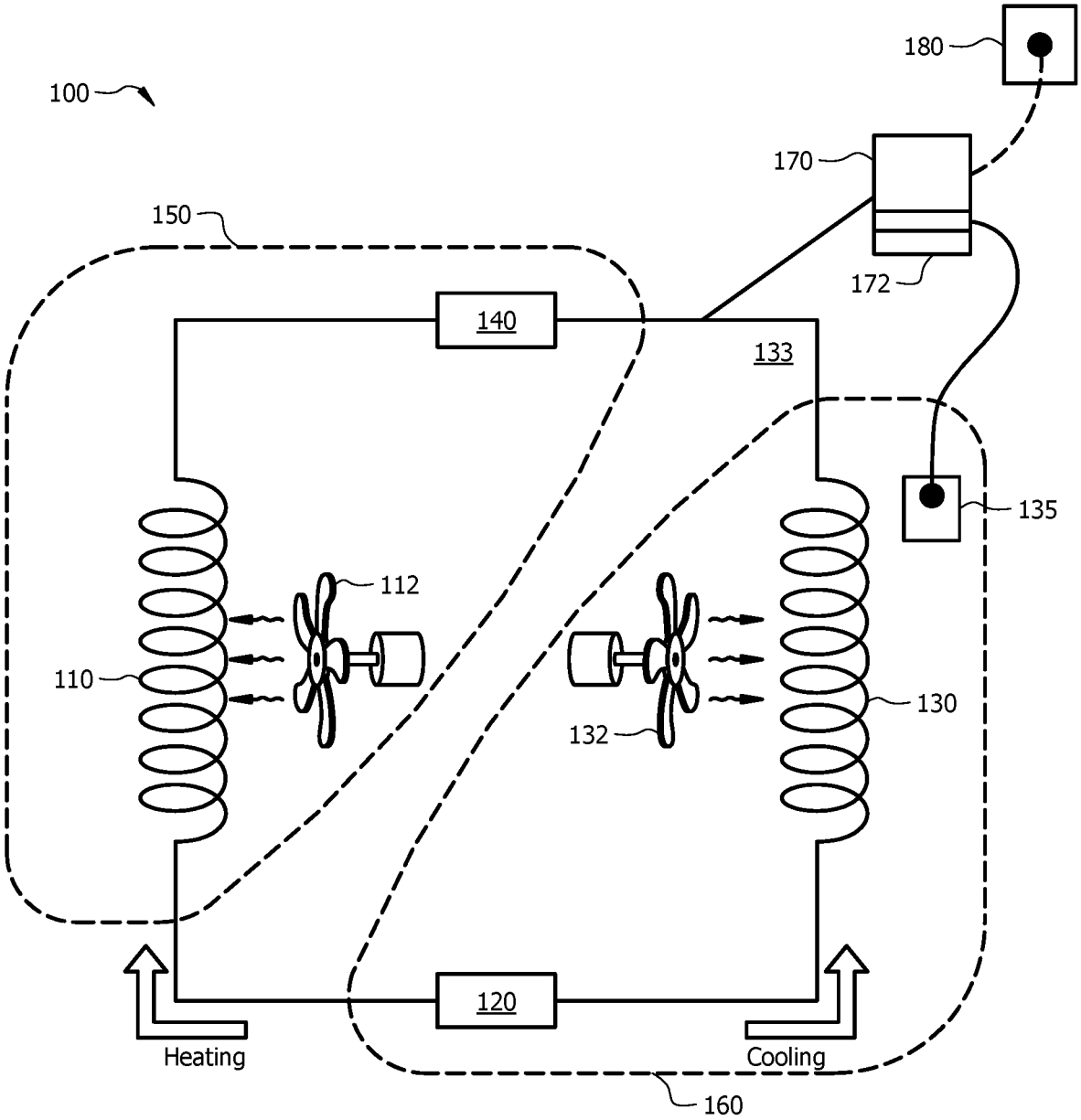
FIG. 1 is a diagram of a possible embodiment under the present disclosure.

Embodiments under the present disclosure can help solve the charge imbalance problems described above. A possible embodiment can be viewed referring to FIG. 1. HVAC system 100 comprises an indoor heat exchanger or coil 110, a compressor 120, an outdoor coil 130, and an expansion device 140. Typically an indoor unit 150 comprises expansion device 140 and inside heat exchanger 110. Outdoor unit 160 typically comprises outside heat exchanger 130 and compressor 120. As displayed here, during a cooling mode the refrigerant flows in a counter-clockwise direction. During cooling mode the indoor coil 110 will comprise an evaporator. Refrigerant will flow from the evaporator, through the compressor 120, and to the outdoor coil that is serving as a condenser. Refrigerant leaving the outdoor coil will enter liquid line 133, pass through an expansion device 140, and return to the evaporator. During heating operations the refrigerant will reverse course and flow clockwise. The indoor coil 110 will become a condenser and the outdoor coil 130 will become an evaporator. Fans/blowers 112, 132 can provide airflow across heat exchangers 110, 130.

During heating operations it may be desirable to remove refrigerant from the system 100. Compensator 170 comprises a connection to liquid line 133. During heating operations, high pressure drives an amount of refrigerant into compensator 170, relieving the pressure. During cooling operations, it is desired to retrieve the extra refrigerant within compensator 170 so that the cooling demand can be met. This is achieved by applying heat to compensator 170 via heater 172. Heater 172 can comprise a belly band heater similar to compressor crank case heaters, or another appropriate type of heater. Heater 172 can be coupled to a controller/processor/electronics 135 in the outdoor unit 160. Optionally, the heater 172 can be coupled to another controller/processor/server/electronics 180, such as a thermostat. When the controller 135 receives a command to begin cooling operations, then the heater 172 can receive a signal to turn on. Turning on heater 172 causes the temperature within compensator 170 to rise higher than the temperature of the indoor coil 110. Refrigerant migrates to cooler locations and refrigerant will therefore leave compensator 170. As refrigerant circulates in the system it will pass by the inlet to the compensator 170 and migrate toward the indoor coil 110 (because the indoor coil is lower temperature than the compensator). The preferred location for plumbing the compensator 170 into the refrigerant line is at the liquid line 133, or anywhere between the outdoor heat exchanger 130 and the expansion device 140.

Figure 2:
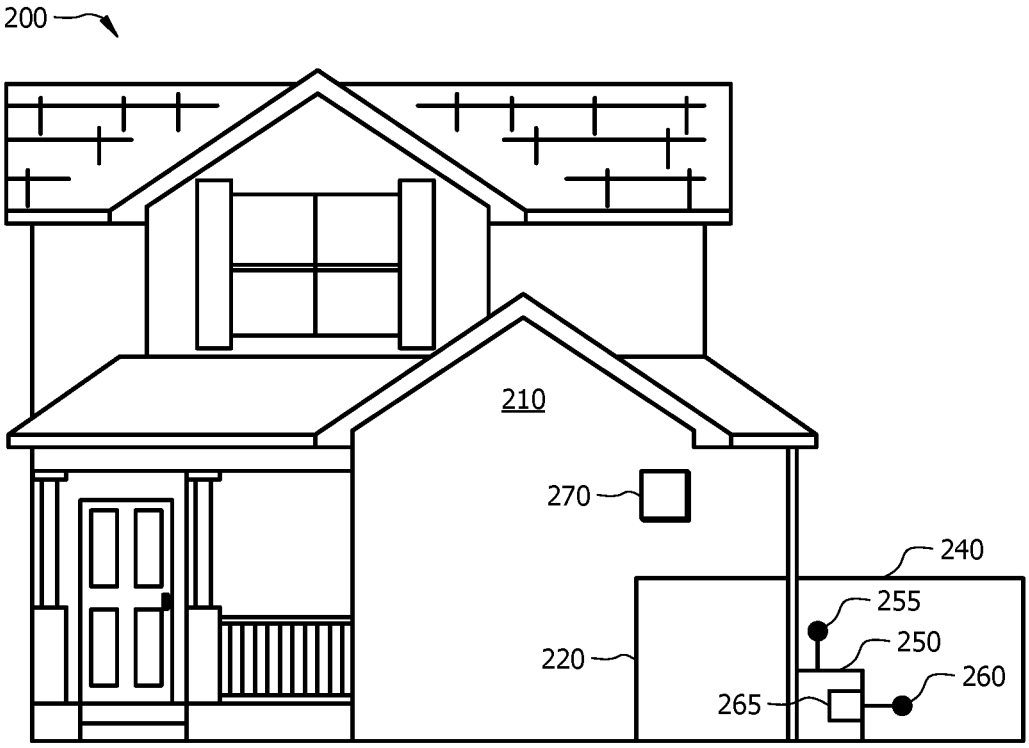
FIG. 2 is a diagram of a possible embodiment under the present disclosure.

A possible retrofit embodiment can be seen in FIG. 2. System 200 comprises a building 210 and associated indoor 220 and outdoor 240 units of an HVAC system. Outdoor unit 240 may have been preexisting and indoor unit 220, or the indoor coil, may be newly installed to replace an old unit. The new indoor unit 220 may comprise an aluminum coil, causing charge imbalance issues. To remedy this, compensator 250 can be installed. Compensator 250 comprises a plumbed connection 255 to the liquid line from the outdoor unit 240. Electrical connection 260 connects a heater 265 on compensator 250 to electronics or a controller in the outdoor unit 240.

A preferred embodiment under the present disclosure comprises a retrofit solution. The teachings could also be implemented in newly-built systems. Solutions under the present disclosure will be particularly helpful when aluminum coils are used to replace copper coils in indoor units. Other embodiments under the present disclosure can be retrofit onto HVAC systems undergoing pressure or charge imbalance issues, even if both indoor and outdoor coils are built from the same materials. Even when copper coils replace copper coils, operating conditions may affect the new coil size or geometry, leading to possible charge imbalance issues. Sometimes an outdoor unit has to be replaced instead of the indoor unit. In these situations and others, the present disclosure can provide help in solving charge imbalances.

Figure 3:
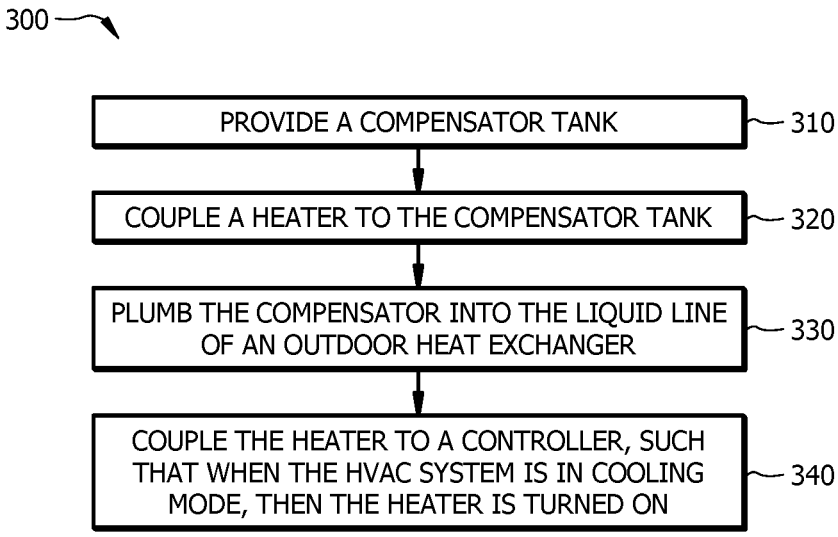
FIG. 3 is a flow chart diagram of a possible method embodiment under the present disclosure.

FIG. 3 displays a possible method embodiment 300 for constructing a compensator under the present disclosure. At 310, a compensator tank is provided. At 320, a heater is coupled to the compensator tank. At 330, the compensator is plumbed into the liquid line of an outdoor heat exchanger. At 340, the heater is coupled to a controller, such that when the HVAC system is in cooling mode then the heater is turned on.

Figure 4:
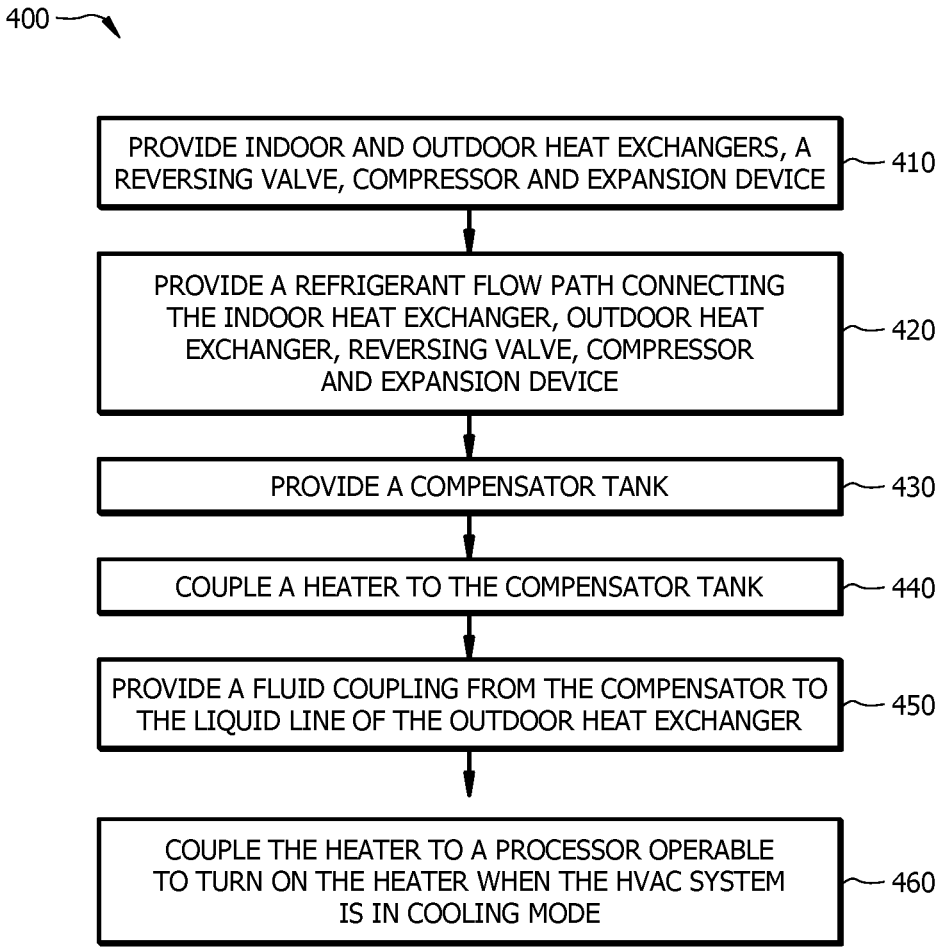
FIG. 4 is a flow chart diagram of a possible method embodiment under the present disclosure.

FIG. 4 displays another possible method embodiment 400 for constructing an HVAC system under the present disclosure. At 410, an indoor heat exchanger, outdoor heat exchanger, reversing valve, compressor, and expansion valve are provided. At 420, a refrigerant flow path is provided for connecting the indoor heat exchanger, outdoor heat exchanger, reversing valve, compressor, and expansion valve. At 430, a compensator tank is provided. At 440, a heater is coupled to the compensator tank. At 450, a fluid coupling is provided from the compensator to the liquid line of the outdoor heat exchanger. At 460, the heater is coupled to a processor operable to turn on the heater when the HVAC system is in cooling mode.

Figure 5:
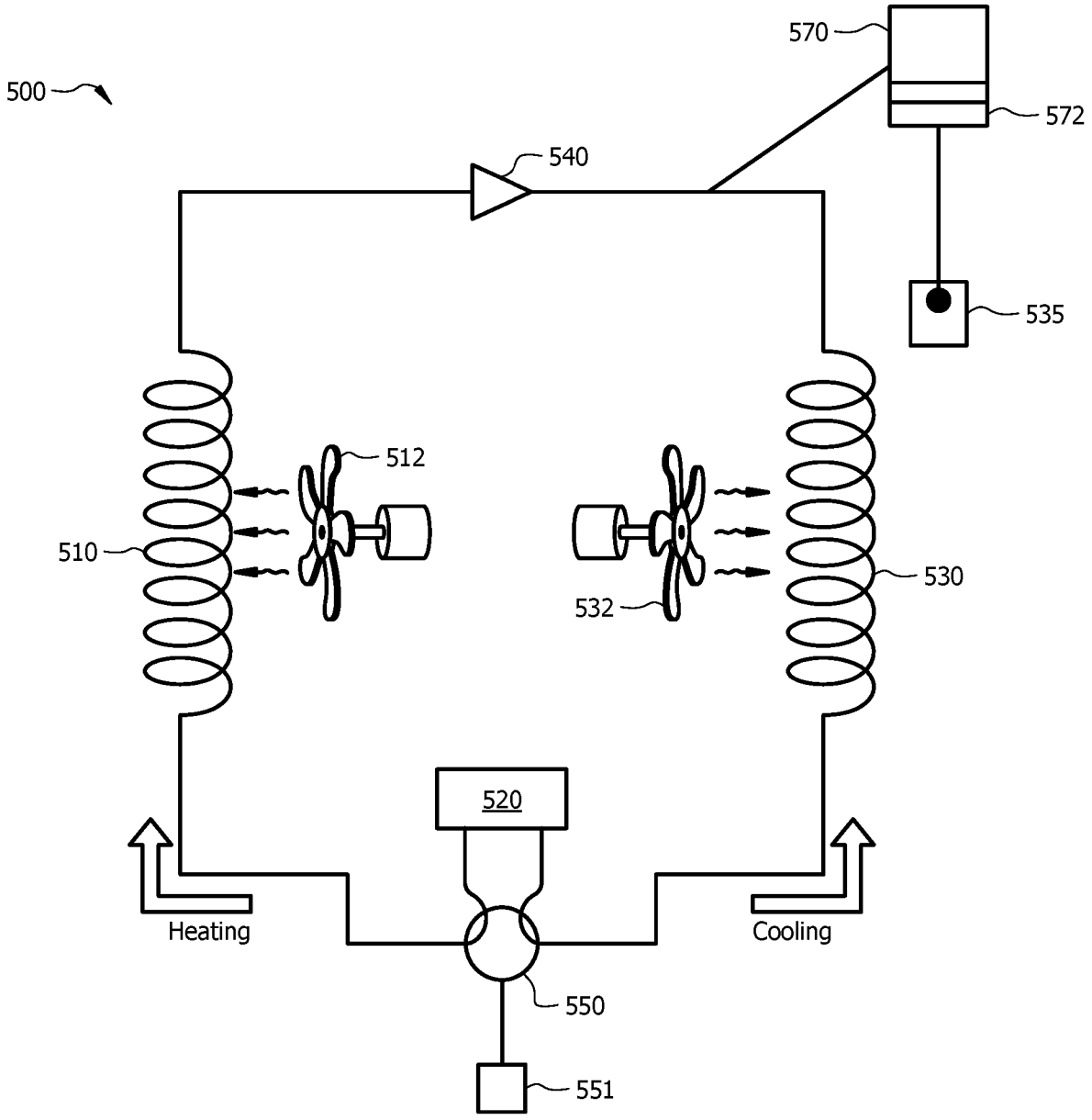
FIG. 5 is a diagram of a possible embodiment under the present disclosure.

FIG. 5 displays another possible system embodiment under the present disclosure. FIG. 5 is similar to FIG. 1 but shows a reversing valve in more detail. System 500 comprises an indoor heat exchanger 510, compressor 520, outdoor heat exchanger 530, and expansion valve 540. Fans 512, 532 provide airflow over the heat exchangers. Reversing valve 550 is disposed between the heat exchangers 510, 530 and is fluidly coupled with compressor 520. A compensator 570, heater 572, and controller 535 are shown in a manner similar to FIG. 1. The direction of refrigerant flow in cooling and heating modes is shown in FIG. 5. Reversing valve 550 can change the direction of refrigerant flow, going from cooling mode to heating mode and vice versa. Valve 550 can comprise a connection to a thermostat/controller/electronics 551 that direct the flow of refrigerant. Heater 572, controller 535 can alternatively comprise a connection to thermostat/controller/electronics 551.

Embodiments under the present disclosure can comprise a variety of heat exchanger types, such as tube and fin, microchannel, and others. Other components such as expansion devices, compressors, reversing valves, and others, are not limited to one type of component but can take a variety of forms known to those skilled in the art.

Figure 6:
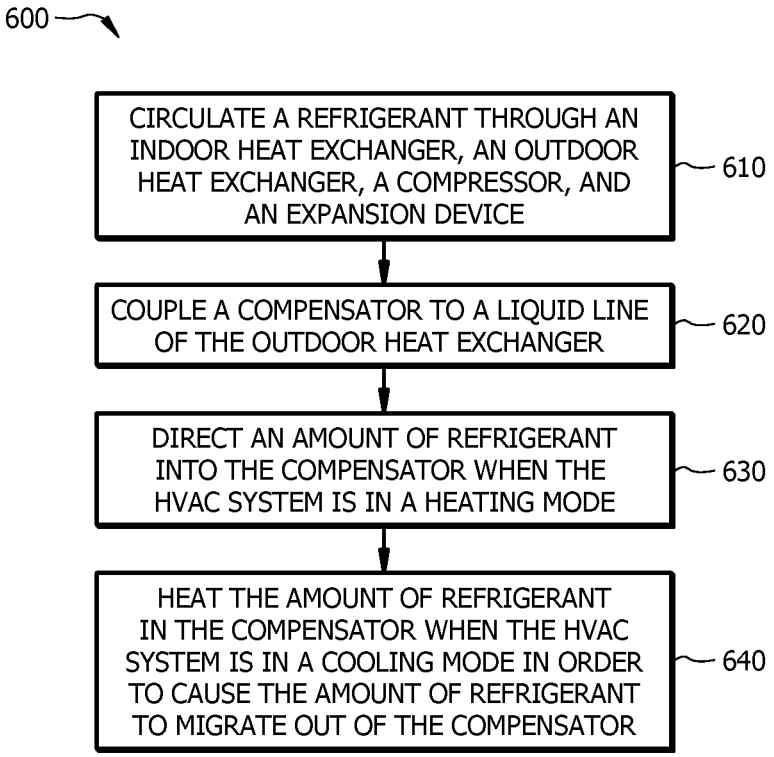
FIG. 6 is a flow chart diagram of a possible method embodiment under the present disclosure.

FIG. 6 displays another possible method embodiment 600 under the present disclosure. Method 600 comprises a process for operating an HVAC system and/or alleviating charge imbalance in an HVAC system that is operable in both a cooling mode and a heating mode. At 610 a refrigerant is circulated through an indoor heat exchanger, an outdoor heat exchanger, a compressor and an expansion device. At 620 a compensator is coupled to a liquid line of the outdoor heat exchanger. At 630, an amount of refrigerant is directed into the compensator when the HVAC system is in a heating mode. At 640, the amount of refrigerant is heated when the HVAC system is in a cooling mode in order to cause the amount of refrigerant to migrate out of the compensator.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A compensator for an HVAC system operable in both a cooling mode and a heating mode, wherein the HVAC system comprises:

an outdoor unit comprising:

an outdoor unit controller electrically coupled to a compressor of the HVAC system, and an outdoor heat exchanger comprising a copper coil with a first internal diameter; and an indoor unit comprising:

a thermostat electrically coupled to the outdoor unit controller, and an indoor heat exchanger comprising an aluminum coil with a second internal diameter, wherein the second internal diameter is less than the first internal diameter;

the compensator comprising:

an inlet coupled to a liquid line of the outdoor heat exchanger;

a tank configured to receive a refrigerant from the liquid line when the HVAC system is operated in the heating mode; and a heater electrically coupled to the outdoor unit controller, wherein the outdoor unit controller is configured, when the outdoor unit controller receives a command from the thermostat to begin operation of the HVAC system in the cooling mode, to provide a signal to the heater causing the heater to turn on, wherein the heater is configured, when turned on, to increase a temperature of the refrigerant in the compensator to a first temperature greater than a second temperature of the refrigerant in the indoor heat exchanger, such that the refrigerant migrates out of the compensator and a cooling demand may be met.

2. The compensator of claim 1, wherein the heater is a belly band heater.

3. The compensator of claim 1 wherein the heater is further configured to turn on response to a signal sent by the thermostat to activate a reversing valve of the HVAC system.

4. An HVAC system operable in both a heating mode and a cooling mode, the HVAC system comprising:

an indoor unit comprising:

a thermostat; and an outdoor heat exchanger configured to receive a refrigerant and transfer heat between the refrigerant and another medium, wherein the indoor heat exchanger comprises an aluminum coil with a first internal diameter;

an outdoor unit comprising:

an outdoor unit controller electronically coupled to the thermostat;

a compressor electronically coupled to the outdoor unit controller and configured to receive the refrigerant from the indoor heat exchanger when the HVAC system is operated in the cooling mode;

an outdoor heat exchanger configured to receive the refrigerant from the compressor when the HVAC system is operated in the cooling mode, an outlet of the outdoor heat exchanger comprising a liquid line, wherein the outdoor heat exchanger comprises a copper coil with a second internal diameter, wherein the first internal diameter is less than the second internal diameter; and an expansion valve configured to receive the refrigerant from the outdoor heat exchanger and to direct the refrigerant toward the indoor heat exchanger when the HVAC system is operated in the cooling mode; and a compensator comprising:

an inlet coupled to a liquid line of the outdoor heat exchanger;

a tank configured to receive the refrigerant from the liquid line when the HVAC system is operated in the heating mode; and a heater electrically coupled to the outdoor unit controller, wherein the outdoor unit controller is configured, when the outdoor unit controller receives a command from the thermostat to begin operation of the HVAC system in the cooling mode, to provide a signal to the heater causing the heater to turn on, wherein the heater is configured, when turned on, to increase a temperature of the refrigerant in the compensator to a first temperature greater than a second temperature of the refrigerant in the indoor heat exchanger, such that the refrigerant migrates out of the compensator and a cooling demand may be met.

5. The HVAC system of claim 4 wherein the heater is a belly band heater.

6. The HVAC system of claim 4 wherein the heater is further configured to turn on in response to a signal sent by the thermostat activate a reversing valve of the HVAC system.

7. A method of alleviating charge imbalance in an HVAC system that is operable in both a cooling mode and a heating mode, the method comprising:

circulating a refrigerant through an indoor heat exchanger comprising an aluminum coil with a first internal diameter, an outdoor heat exchanger comprising a copper coil with a second internal diameter that is greater than the first internal diameter, a compressor and an expansion device, wherein a compensator is coupled to a liquid line of the outdoor heat exchanger;

receiving, from a thermostat of the HVAC system, a command to operate the HVAC system in the heating mode;

following receipt of the command to operate the HVAC system in the heating mode, allowing refrigerant to flow into the compensator when the HVAC system is operated in the heating mode;

receiving, from the thermostat, a command to operate the HVAC system in the cooling mode;

following receipt of the command to operate the HVAC system in the cooling mode, applying heat to the compensator, by turning on a heater of the compensator, at least until a first temperature of the refrigerant in the compensator is greater than a second temperature of the refrigerant in the indoor heat exchanger, such that the refrigerant in the compensator migrates out of the compensator and a cooling demand may be met.

8. The method of claim 7 further comprising providing an enclosure around the compensator.

9. The method of claim 8 further comprising attaching the enclosure to a surface.

10. The method of claim 7 wherein the heater is a belly hand heater.

11. The method of claim 7, further comprising receiving a signal, from the thermostat, to activate a reversing valve of the HVAC system and turn on the heater.

* * * * *